US005558373A

United States Patent [19]

Lesley et al.

[11] Patent Number: 5,558,373

[45] Date of Patent: Sep. 24, 1996

[54] PINBALL MACHINE WITH MOVING FEATURE

[75] Inventors: Paul M. Lesley; Michael D. Toler, both of Chicago, Ill.

[73] Assignee: Sega Pinball, Inc., Melrose Park, Ill.

[21] Appl. No.: 337,736

[22] Filed: Nov. 14, 1994

[51] Int. Cl.[6] ..... A63F 7/02; A63F 7/30

[52] U.S. Cl. ..... 273/119 R; 273/118 R; 273/118 A; 273/119 A

[58] Field of Search ..... 273/118, 119, 273/121, 129 R, 129 V, 129 W

[56] References Cited

U.S. PATENT DOCUMENTS 4,971,324 11/1990 Grabel et al. ..... 273/119 X
5,112,049 5/1992 Borg ..... 273/118 R X
5,123,647 6/1992 Lawlor .
5,330,182 7/1994 Kaminkow ..... 273/118 A X
5,358,244 10/1994 Kaminkow et al. .

*Primary Examiner*—Raleigh W. Chiu
*Attorney, Agent, or Firm*—Gerstman, Ellis & McMillin, Ltd.

[57] ABSTRACT

A pinball machine comprises a position controller and a movable feature on the pinball machine. The position controller comprises a servomotor connected in operative relation to a shaft. The movable features connect to the shaft and are movable between several positions by the shaft. Circuitry is provided to produce a signal to command movement of the feature to one of the positions in a manner responsive to an event taking place in the pinball machine. Electronic circuitry causes the servomotor to move the shaft to a specific position in response to the signal, without the need for mechanical switches. Specifically, a plate-like, movable obscurer for the flippers is disclosed as the movable feature, although other types of movable features are discussed.

9 Claims, 5 Drawing Sheets

PINBALL MACHINE WITH MOVING FEATURE

BACKGROUND OF THE INVENTION

Popular pinball games of the prior art generally carry moving features of various types, for example figures with moving arms, moving heads, or the like. Note for example the dinosaur in the Jurassic Park Pinball game or the moving arm in the pinball game featuring Bullwinkle the Moose, sold by The Data East Pinball Company. Typically, the movement of the feature is provided by motors that are controlled by mechanical switches, for example, spring-arm microswitches or the like.

Kaminkow et al. U.S. Pat. No. 5,358,244 shows a pinball machine having a movable feature, specifically a movable dinosaur head, in which the motion is governed and limited by the opening and closing of switches. Lawlor et al. U.S. Pat. No. 5,123,647 discloses a moving head in a pinball machine.

Systems in which the movement is governed by motors controlled by switches must necessarily be rather simple in terms of patterns of the motion. Typically, the motion of the feature is from position a to position b and back again, such as a moving arm or head.

By this invention, a control system for the moving of features is provided which has a quicker response time, better accuracy of motion to a specific position, and has a reduced cost since microswitches or other mechanical switches are not required. Furthermore, the pattern of motion of a head, an arm, or any other desired moveable feature can be complex if desired, movable between a substantial number of positions, for example three to fifty positions. The movement may be of any desired complex pattern as controlled by a microprocessor, so that basically the same system can be used to impose different moving patterns on different features, depending upon the programming in the microprocessor.

As one specific embodiment of the above, a pinball machine may be provided in which a portion of the playfield may be selectively obscured by a moving plate or the like for obscuring a portion of the playfield. Thus, with this disadvantage being applied at times, the pinball machine exhibits a greater challenge for skilled players. This movable obscuring plate may move between two or more desired positions in a manner governed by events taking place in the pinball machine.

DESCRIPTION OF THE INVENTION

In accordance with this invention, a pinball machine is disclosed having a movable feature. In the specific embodiment below, the movable feature is a pivotable shield for obscuring the manually operated ball flippers, commonly found on pinball machines. Means are provided for deploying and retracting the flipper obscurer such that the flipper is not visible to the player when the flipper obscurer is deployed, and is visible to the player when the flipper obscurer is retracted.

Further by this invention, a position controller for a movable feature on a pinball machine such as the flipper obscurer is provided. However, the position controller of this invention may be used with other movable features, for example arms, legs, and heads on figures, so that, for example, the head of a figure carried on the pinball machine can move back and forth between a large variety of typically five to twenty positions, back and forth and up and down, to provide a lifelike characteristic to the figure, which may be of a monster or other pinball machine character.

A servomotor is connected in operative relation to a shaft. The movable feature of the pinball machine is connected to the shaft, and is movable between a plurality of positions by the shaft. The term "shaft" commonly indicates a rotatable member, which is the type of shaft often used here, but also a shaft may be moved in longitudinal and/or lateral directions by the servomotor in accordance with this invention, with or without rotation as may be desired.

Furthermore in accordance with this invention a microprocessor may be present to provide a signal to command movement of the feature to one of its predetermined positions in a manner responsive to an event taking place in the pinball machine. The event may simply be the elapsing of a timer resulting in a signal for such motion. The event may result from the ball striking a special target, or the event may be a manual signal by the player, etc.

Electronic circuitry are provided for causing the servomotor to move the shaft to a specific position in response to a command signal, for example from the microprocessor. By this invention, the above can be accomplished without the use or the need of mechanical switches. Accordingly, the response time for the moving process is quicker, and the motion is with better accuracy. The various positions may also be programmed into the microprocessor, so that by altering the program the positions and the pattern of the movements may be varied. The various positions may be controlled by a CPU so that the movable feature stops in different places as may be desired.

Specifically, the electronic circuitry may comprise circuitry for receiving the signal and for producing an output pulse of controlled width in response thereto. Then, more electronic circuitry is provided for receiving the output pulse and for causing the servomotor to move the shaft and the connected, movable feature to any of the positions in a selective manner, depending on the specific width of the output pulse received. In other words, if the output pulse is of duration A, the circuitry causes the servomotor to move the shaft and connected, movable feature to position B. If, however, the duration of the output pulse is of duration C, then in that circumstance the circuitry causes the servomotor to move the shaft and connected movable feature to position D. Further, the direction of rotation of the shaft may also be responsive to the pulse duration (width).

The above may be utilized to provide a number of predetermined positions for a desired connected movable feature, to provide an exciting, lifelike pattern of motion without the need for mechanical switches that must open, close, and wear out.

Specifically, when the pinball machine of this invention carries a flipper obscurer plate as discussed above, the flipper obscurer may comprise one or a pair of fan-shaped members, pivotally mounted to move between a stacked array when retracted, and a side-by-side array covering the flipper or flippers present when deployed.

The fan-shaped members may carry a barrier member to prevent the fan-shaped members in side-by-side array from becoming rotationally spaced from each other. Such a barrier member may be a simple projection extending out from the edge of one of the fan-shaped members, to engage a projection or a recess on the other fan-shaped member. Thus, one of the fan shaped-members can actively rotate into deployed position, while pulling the other fan-shaped member along into its deployed position.

One of the fan-shaped members may define a substantially radial slot, relative to the pivoting axis for the one-fan-shaped member, with the pinball machine comprising a motor-driven rotary shaft, which shaft has been previously described in conjunction with the position controller mechanism. The shaft may carry a pivot arm in this circumstance that moves with the rotary shaft, the pivot arm having a free end that slidingly engages the slot. Thus, the one fan-shaped member can be rotated between retracted and deployed positions by rotation of the shaft. The presence of the free end sliding in the slot permits this rotation, even though the rotating shaft is not positioned on the axis of rotation of the fan-shaped member.

Then, the other of the fan-shaped members may be spring-biased toward its retracted position. Thus, the one fan-shaped member can draw the other fan-shaped member in pivotal motion from the retracted to the deployed position. Then, as the one fan-shaped member is moved back to its retracted position by the rotating shaft, the other fan-shaped member spontaneously retracts due to the spring bias.

DESCRIPTION OF THE DRAWINGS

FIG. 8 is a diagram of the circuit board used in the design of FIG. 7 for controlling the position of a movable feature or features for a pinball machine, the feature being typically the head of a monster or the like.

DESCRIPTION OF SPECIFIC EMBODIMENTS

Figure 1:
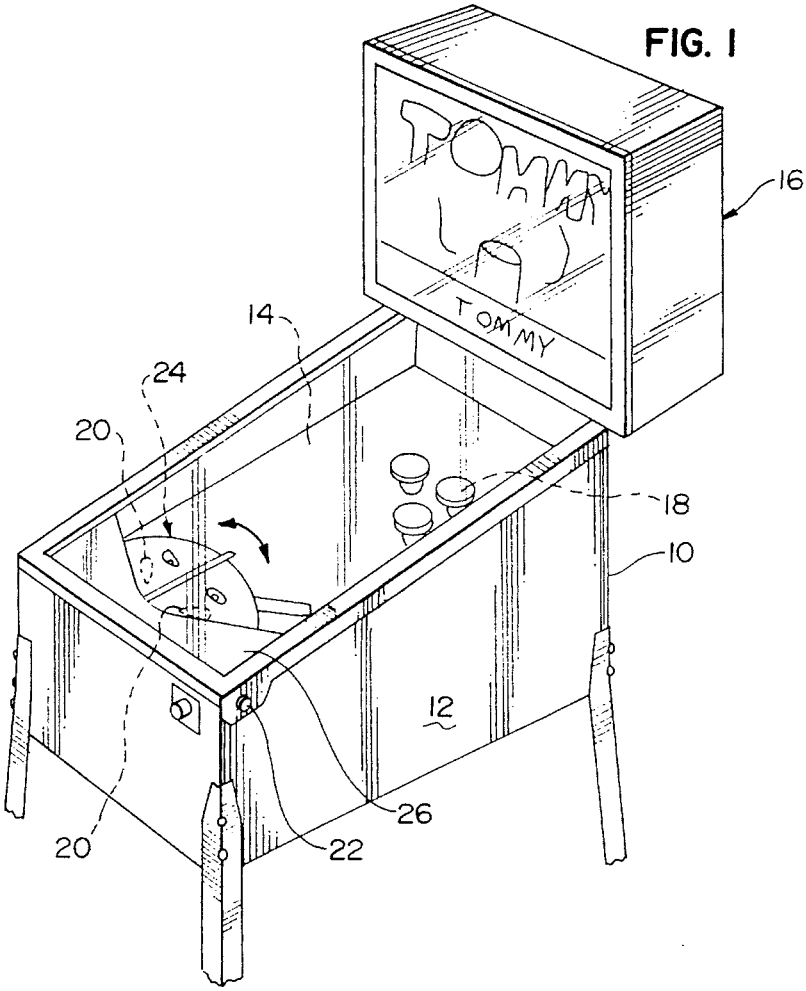
FIG. 1 is a perspective view of a pinball machine, incorporating the invention of this application.

Referring to FIGS. 1 through 5, a pinball machine 10 is shown, having a frame 12 which carries a playfield 14, generally under a glass panel. A backboard 16 is provided in the conventional manner for display and scoring purposes.

Playfield 14 defines various conventional targets 18, only a few of which are shown, and conventional flippers 20, which are manually controlled in the conventional manner by flipper buttons 22 on opposed sides of the casing 12.

In accordance with this invention, a movable shield or flipper obscurer 24 is provided, being shown in FIG. 1 in its deployed position to obscure the flippers 20. Thus, the level of skill required for effective playing of the pinball machine rises, since the user is blinded with respect to the position of rolling balls as they approach the flipper, forcing the skilled user to use other senses than the eyes, for example the timing sense.

Figure 2:
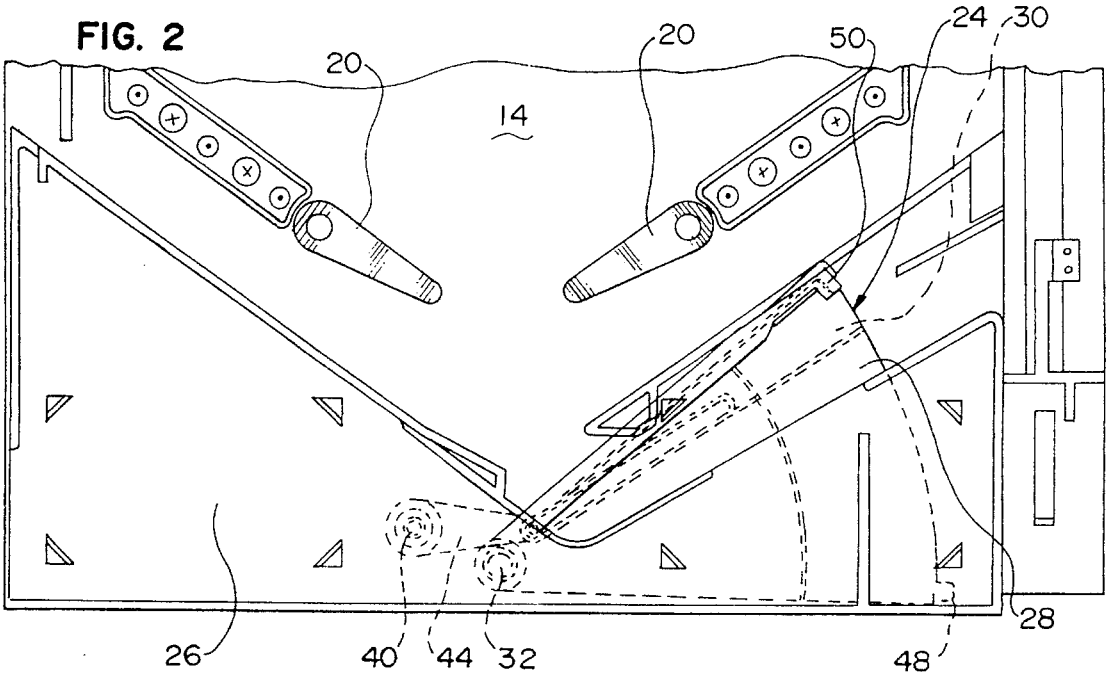
FIG. 2 is a fragmentary, plan view of a portion of the playfield which is nearest the player, showing the flippers, and the flipper obscurer in its retracted position.

As described above, the flipper obscurer 24 also occupies a retracted position as shown in FIG. 2. In this position, most of the flipper obscurer is retracted under horizontal partition 26, so that the flippers 20 and their engagement with rolling balls can be seen by the user.

By this invention, flipper obscurer 24 comprises a pair of fan-shaped members 28, 30, each of which are pivotally and coaxially mounted, being each independently pivotable thereon. A coaxial outer pivot member 34 provides the pivoting action for fan-shaped member 30, while the central pivot member 32 controls fan-shaped member 28. Furthermore, inner pivot 32 is biased by coil spring 36 toward its retracted position as shown in FIG. 2, but pivot 34 and fan-shaped pivot member 30 are not spring biased.

Instead, pivot member 30 defines a substantially radial slot 38, typically extending only partially through, or all way through from the bottom toward the top.

A rotary shaft 40 is provided, driven by servomotor 42. Pivot arm 44 extends radially outwardly from shaft 40 and moves with the shaft.

Pivot arm 44 has a free end incorporating a transverse pin 46 that engages slot 38. Thus, servomotor 42 can rotate shaft 40 to move fan-shaped member 30 from its retracted position of FIG. 2 to its deployed position of FIG. 5 through the intermediate position of FIG. 4.

Electronic circuitry 46 controls servomotor 42 in a manner responsive to events taking place in the pinball machine, so that fan-shaped member 30 occupies either its retracted or deployed position in accordance with signals from the circuitry.

Figure 3:
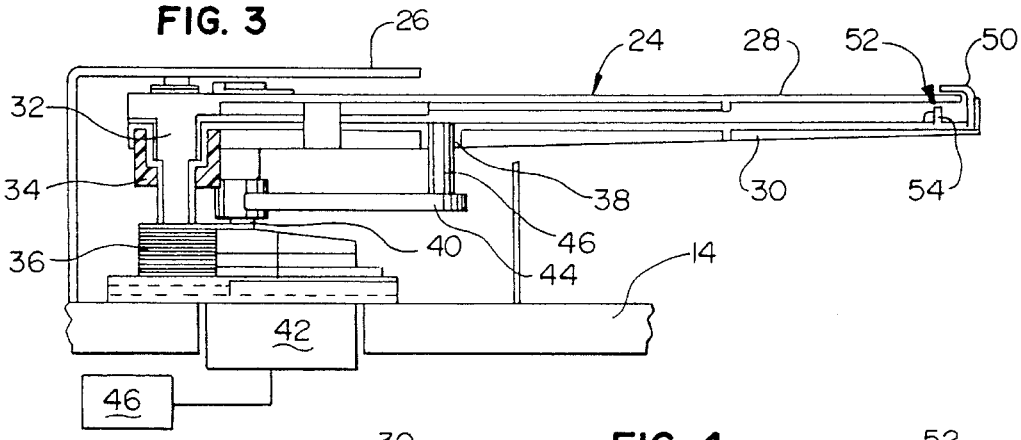
FIG. 3 is a fragmentary, elevational view showing the flippers in their retracted position, and also showing the mechanism for rotating the flippers.
Figure 4:
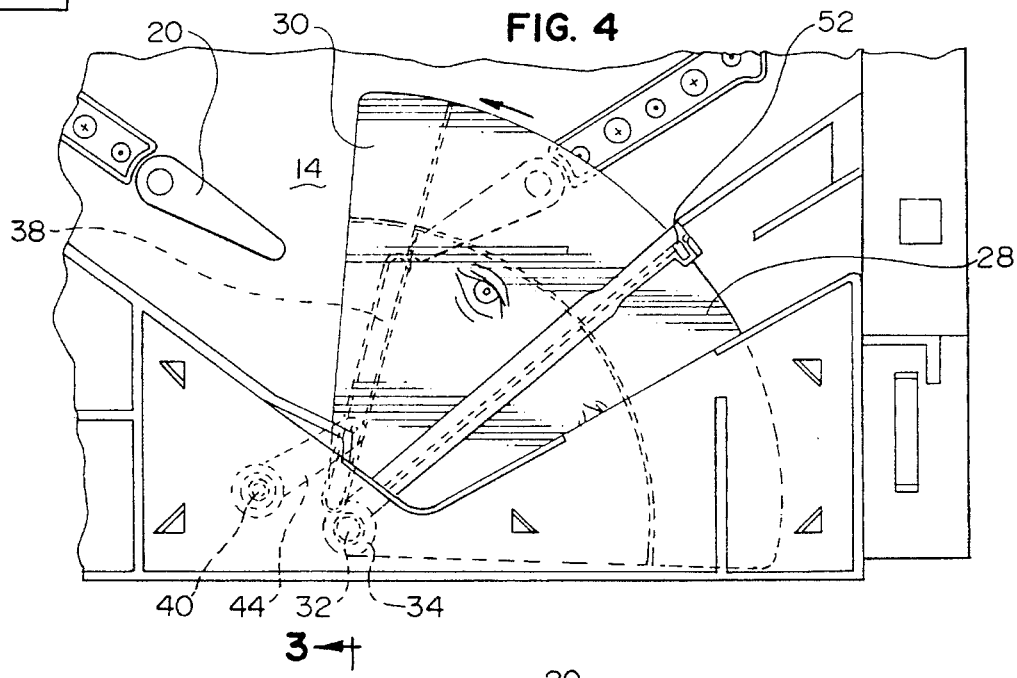
FIG. 4 is a fragmentary, plan view of the portion of the playfield nearest to the user, showing the flipper obscurer partially advanced toward its deployed position.
Figure 5:
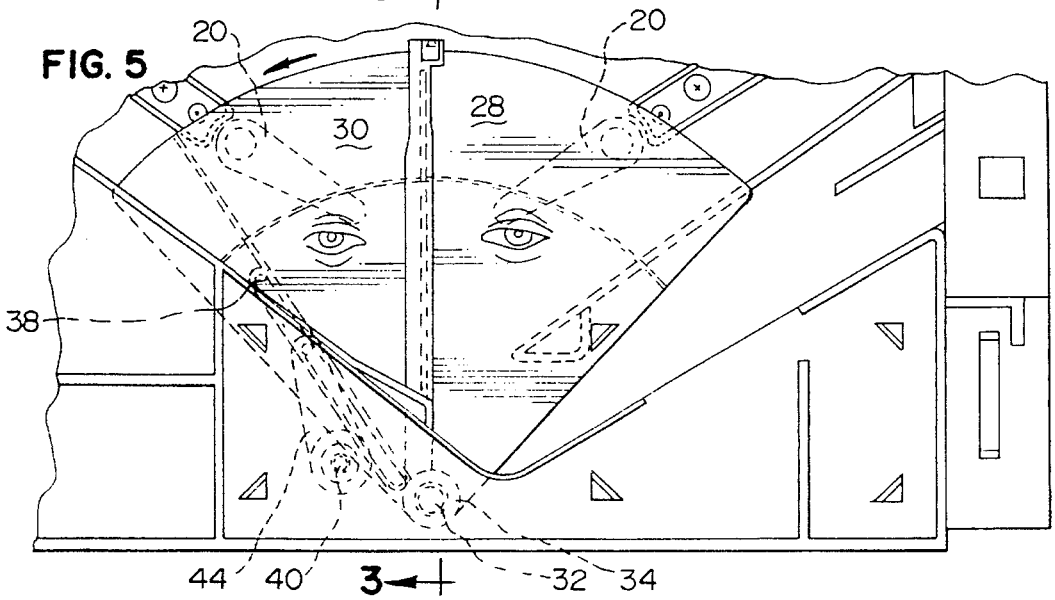
FIG. 5 is a fragmentary plan, view similar to FIG. 4, showing the flipper obscurer in fully deployed position.

Radial tab 48, carried by fan-shaped member 28 (FIG. 2) engages upstanding rib 50, which is carried by the other fan-shaped member 30 to form an interacting barrier member 52 that is present to prevent the fan-shaped members, when in side-by-side array (as in FIG. 5) from becoming rotationally spaced from each other. Since the barrier member 52 prevents this, fan member 30, when pulled into its deployed position by shaft 40, pulls fan member 28 along into similarly deployed position, as shown in FIG. 5, because barrier member 52 prevents lateral separation of the fan members, but permits them to lie in stacked array when retracted, as shown in FIGS. 2 and 3. Rib 50 is of inverted L shape, to prevent upward movement of fan shaped member 28, which might cause disengagement of members 48, 50 and failure of the barrier member. Spacer member 54 prevents collapse of members 28, 30 together.

When the circuitry 46 signals retraction of the fan-shaped members, servomotor 42 rotates shaft 40 to cause fan-shaped member 30 to move back to its retracted position of FIG. 2. Spring 36 causes fan-shaped member 28 to follow into the retracted position.

Thus, a moving member of a pinball machine is provided, in which the motion, simple or complex, may be controlled by an electronic system, achieving the advantages discussed above.

Figure 6:
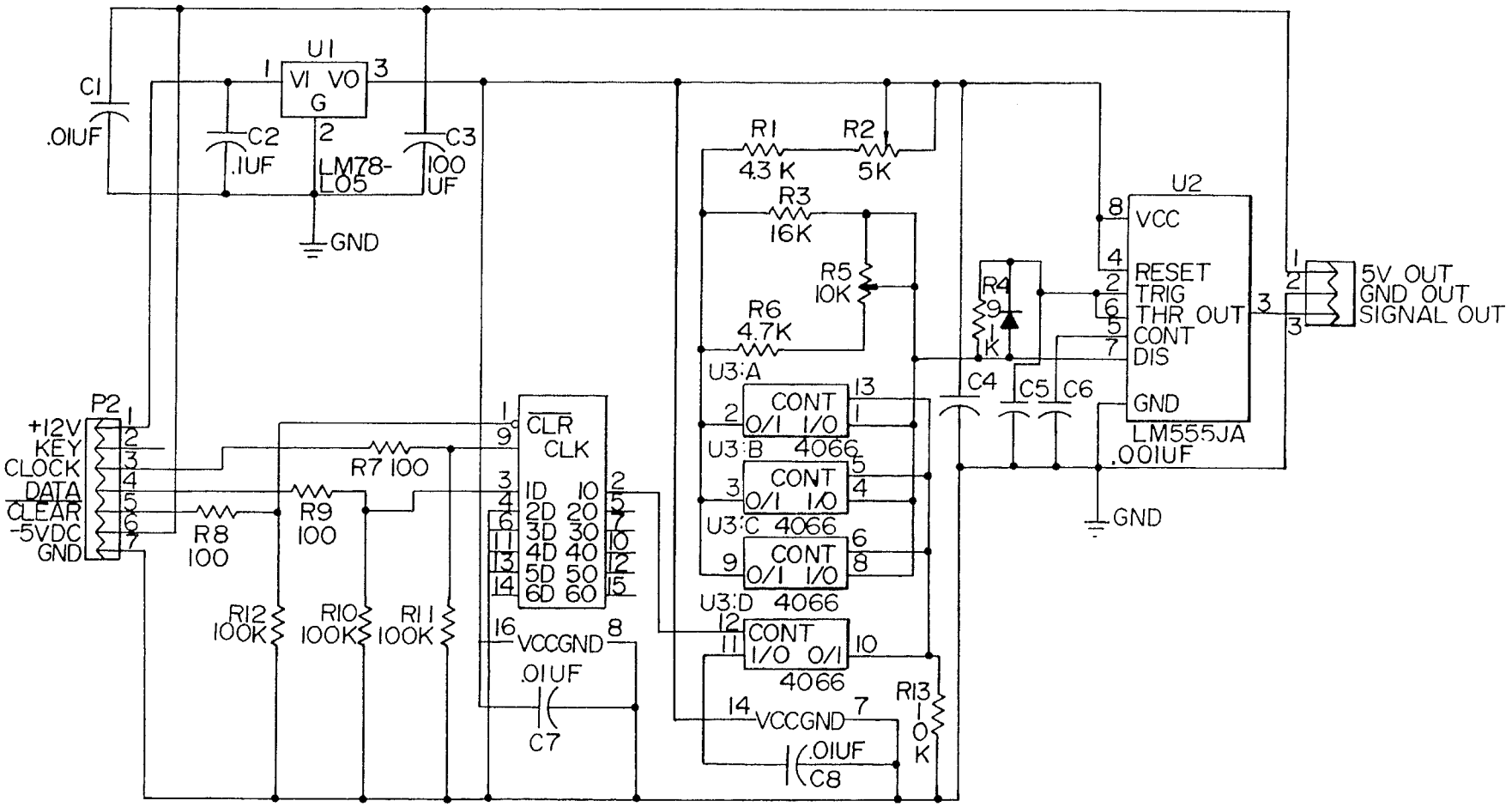
FIG. 6 is a diagram of circuit board used to control the movement of the flipper obscurer as disclosed in the previous drawings.

In the circuit 46 illustrated in FIG. 6, connector P2 is provided to take the data input from the CPU and send one bit code to flip-flop U4. Flip-flop U4 takes the single bit data on pin 3, clocks it to pin 2 and clears to 0 on pin 1. When the data is high, flip-flop U4 switches on U3:D from pin 12. U3:A, U3:B and U3:C also go on. The U3 switches operate to effectively short out resistors R3, R5 and R6.

The timing pulse is generated by an astable multivibrator U2. The width of the timing pulse is controlled by resistors R1, R2, R3, R4, R5 and R6 and capacitor C5. When U3:A, B, C, D are switched on, they take resistors R3, R5 and R6 out of the network to provide a different pulse width than when resistors R3, R5 and R6 are in the network. Resistors R2 and R5 are adjustable to provide a predetermined pulse width when all of the resistors are in the network and when only some of the resistors are in the network. In one condition, the pulse width is utilized to cause a pulse-width controlled servo 42 to turn clockwise while in another condition the pulse-width causes the servo 42 to turn counter-clockwise, in each case to a predetermined position.

Figure 7:
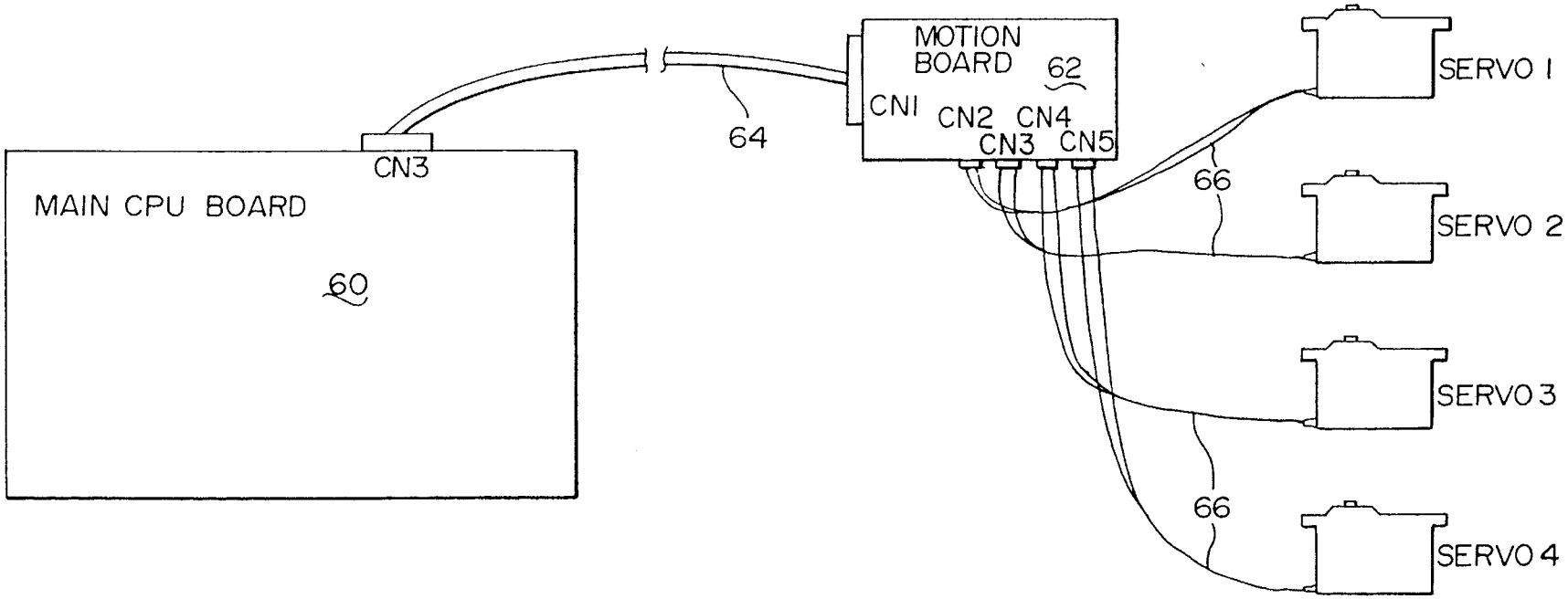
FIG. 7 is a diagram of an electronic system for controlling four servomotors on a pinball machine, for providing movable features.

Referring to FIG. 7, an electronic system for controlling movable features of a pinball machine is disclosed. The main CPU board 60 is present in the pinball machine to control all pinball machine functions, as is conventional.

Figure 8:
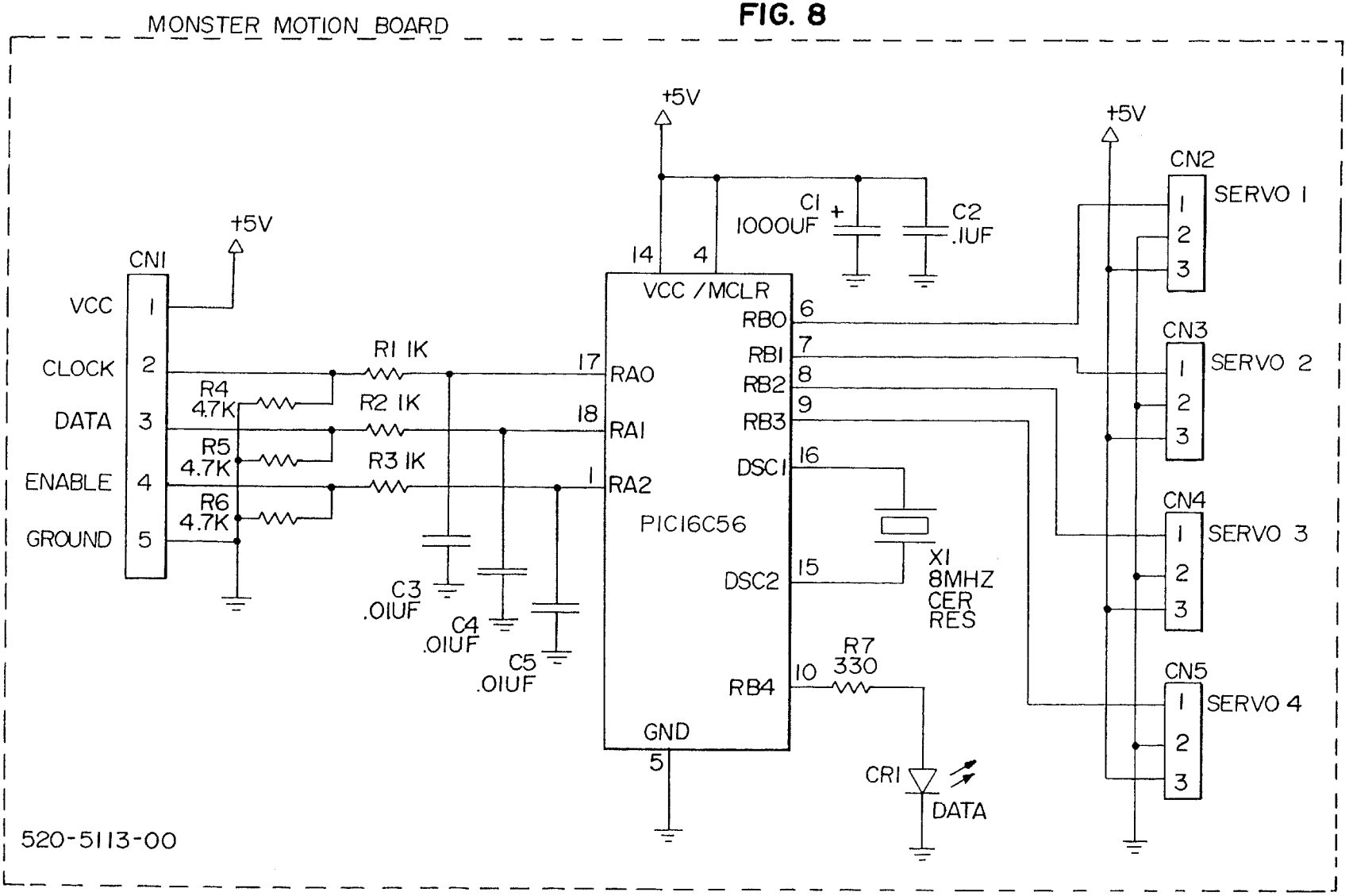

The motion board 62 represents another circuit board which is more specifically shown in FIG. 8, being connected to main CPU board 60 by a cable 64. Motion board 62, in turn is connected by flat cables 66 to preferably a plurality of different pulse-width controlled servomotors as shown, which servomotors are capable of operating various movable features on a pinball machine. For example, the flipper obscurer 24 of the previous embodiment may be controlled by one of the servomotors. If desired, only a single motor can be used in conjunction with the embodiment of FIG. 7, or any desired number of such servomotors may be used.

Thus, a pinball machine may carry several moving features controlled by the system of Claim 7, with each moving feature being independently controlled by a separate servomotor, essentially any number of which may be connected to one or more motion boards 62 which connect with main CPU board 60. Thus, various figures on the pinball machine may have movable heads, arms, or legs. Doors or windows may open and close; mechanical arms may move here and there; wings may flap; faces may go through various expressions; and the like.

The circuit board of FIG. 8 operates the several pulse-width controlled servo motors of FIG. 7 in a manner in which each servo can be controllable up to 256 positions. The circuit utilizes a microcontroller, which in the illustrative embodiment (although no limitation is intended) is Microchip Model PIC16C56. Input filters comprising R1, R2, R3, R4, R5, R6, C3, C4 and C5 are utilized to reduce electrical noise and are coupled to input pins 1, 17 and 18 of the microcontroller.

The five volt supply is coupled to pin 14 and to reset pin 4. A low frequency components filter capacitor C1 and a high frequency components filter capacitor C2 are coupled to pins 14 and 4. Output pins 6, 7, 8, 9 are, respectively, coupled to servomotors 1, 2, 3 and 4. A ceramic resonator X1 is coupled across pins 15 and 16 to set the oscillator frequency which, in the illustrative embodiment, is 8 megahertz. CR1 is an LED, coupled through resistor R7 to pin 10. The LED blinks to show the operation of the circuitry.

Serial data is clocked out of the main CPU board (See FIG. 7) to connector CN1 at 125 bits per second. The data is accompanied by a transition-sensitive clock (both rising and falling transitions) and an active-high enable. The CPU sends 8 bit words to the servo board to trigger prerecorded routines stored in the microcontroller on the circuit board of FIG. 8. Since the clock is transition sensitive, there are only four pulses on the clock for each 8 bit data word. The data is sampled a fraction of a second after each transition to insure a stable read of the data state.

The signal to the servomotors comprises a short pulse to +5 V ranging in duration from 0.3 msec. to 1.7 msec., repeating every 16.3 msec. The duration of the short pulse determines the servomotor's position. At 1 msec. the servomotor is centered. On power-up, the servo board will blink its LED a few times and then send centering signals to all four of its servos until it receives a command code from the CPU. Thus a 1 msec. pulse centers the servo, a 3 msec. pulse moves the servo as far counterclockwise as possible and a 1.7 msec. pulse moves the servo as far clockwise as possible. All of the servos are pulse-width controlled servos which can work alone or in combination with each other. Their positions can be varied depending on the width of the pulse and the servos are movable to 256 different pulse-width controlled positions in this particular embodiment.

It is to be understood that the foregoing servo control circuits of FIG. 6 and FIG. 8 are illustrative embodiments only, and there are many other servomotor control systems which could be utilized with the present invention in an equivalent manner.

Although illustrative embodiments of the invention have been described, it is to be understood that various modifications and substitutions may be made by those skilled in the art without departing from the novel spirit and scope of the present invention.

That which is claimed is:

1. A pinball machine which comprises;

a housing which carries a playfield;

a plurality of targets and play features on said playfield;

at least one manually operated ball flipper on said playfield;

a flipper obscurer; and means for deploying and retracting said flipper obscurer such that said flipper is not visible to the player when said flipper obscurer is deployed and is visible to the player when said flipper obscurer is retracted.

2. The pinball machine of claim 1 in which said flipper obscurer comprises a pivotally mounted, fan-shaped member.

3. The pinball machine of claim 2 in which said flipper obscurer comprises a pair of fan-shaped members pivotally mounted to move between a stacked array when retracted, and a side-by-side array covering said at least one flipper when deployed.

4. The pinball machine of claim 3 in which said fan-shaped members carry a barrier member to prevent the fan-shaped members in side-by-side array from becoming rotationally spaced from each other, whereby one fan-shaped member can actively rotate into deployed position while pulling the other fan-shaped member along into said deployed position.

5. The pinball machine of claim 4 in which one of said fan-shaped members defines a slot relative to the pivoting axis for said one member; said pinball machine comprising a motor-driven rotary shaft, said shaft carrying a pivot arm that moves with said rotary shaft, said pivot arm having a free end that slidingly engages said slot, whereby said one fan-shaped member can be rotated between retracted and deployed positions by rotation of said shaft.

6. The pinball machine of claim 5 in which the other of said fan-shaped members is spring-biased toward said retracted position, whereby said one fan-shaped member draws said other member in pivotal motion from said retracted to said deployed position.

7. The pinball machine of claim 3 in which one of said fan-shaped members defines a substantially radial slot relative to pivoting axis for said one member; said pinball machine comprising a motor-driven rotary shaft, said shaft carrying a pivot arm that moves with said rotary shaft, said pivot arm having a free end that slidingly engages said slot, whereby said one fan-shaped member can be rotated between retracted and deployed positions by rotation of said shaft.

8. The pinball machine of claim 7 in which the other of said fan-shaped members is spring-biased toward said retracted position, whereby said one fan-shaped member draws said other member in pivotal motion from said retracted to said deployed position.

9. The pinball machine of claim 1 in which at least a pair of manually operated ball flippers are mounted on the playfield in a position to each be covered by said flipper obscurer in the deployed position.

* * * * *